US005183098A

United States Patent [19]

Chagnot

[11] Patent Number: 5,183,098

[45] Date of Patent: * Feb. 2, 1993

[54] AIR TO AIR HEAT RECOVERY VENTILATOR

[75] Inventor: Catherine J. Chagnot, Athens, Ohio

[73] Assignee: Stirling Technology, Inc., Athens, Ohio

[ * ] Notice: The portion of the term of this patent subsequent to Dec. 3, 2008 has been disclaimed.

[21] Appl. No.: 665,976

[22] Filed: Mar. 7, 1991

Related U.S. Application Data

[63] Continuation-in-part of Ser. No. 395,044, Aug. 17, 1989, Pat. No. 5,069,272.

[51] Int. Cl.[5] ..... F28D 19/04

[52] U.S. Cl. ..... 165/8; 165/9; 165/54; 55/390

[58] Field of Search ..... 165/8, 7, 10, 9, 54; 55/390, 389

[56] References Cited

U.S. PATENT DOCUMENTS

| | | | |
|---|---|---|---|
| 2,807,258 | 9/1957 | Pennington | 165/10 |
| 3,733,791 | 5/1973 | Dravnieks . | |
| 3,844,737 | 10/1974 | Macriss et al. | 55/390 |
| 4,093,435 | 6/1978 | Marron et al. . | |
| 4,188,993 | 2/1980 | Heyn et al. | 165/8 |
| 4,196,771 | 4/1980 | Nitteberg . | |
| 4,426,853 | 9/1984 | Mitani et al. . | |
| 4,429,735 | 2/1984 | Nomaguchi et al. . | |
| 4,432,409 | 2/1984 | Steele . | |
| 4,491,171 | 1/1985 | Zenkner . | |
| 4,497,361 | 2/1985 | Hajicek | 165/8 |
| 4,513,807 | 4/1985 | Rose et al. . | |
| 4,542,782 | 9/1985 | Berner . | |
| 4,563,126 | 1/1986 | Kobayashi | 165/7 |
| 4,572,282 | 2/1986 | Ikemura et al. | 165/54 |
| 4,594,860 | 6/1986 | Coellner et al. . | |
| 4,596,284 | 6/1986 | Honmann . | |
| 4,611,653 | 9/1986 | Ikemura et al. | 165/54 |
| 4,688,626 | 8/1987 | Tengesdal . | |
| 4,711,293 | 12/1987 | Niwa et al. . | |
| 4,727,931 | 3/1988 | Berner . | |
| 4,874,092 | 10/1989 | Becker | 165/54 |
| 4,875,520 | 10/1989 | Steele et al. . | |

FOREIGN PATENT DOCUMENTS

| | | | |
|---|---|---|---|
| 0030863 | 6/1981 | European Pat. Off. . | |
| 2318007 | 10/1974 | Fed. Rep. of Germany . | |
| 2839112 | 3/1979 | Fed. Rep. of Germany . | |
| 3125504 | 2/1983 | Fed. Rep. of Germany . | |
| 58-138992 | 8/1983 | Japan . | |
| 55587 | 3/1986 | Japan | 165/9 |
| 748311 | 4/1956 | United Kingdom | 165/54 |

*Primary Examiner*—Albert W. Davis, Jr.
*Attorney, Agent, or Firm*—Killworth, Gottman, Hagan & Schaeff

[57] ABSTRACT

A heat recovery ventilator having a rotary wheel heat exchanger uses a random matrix media of randomly interrelated small diameter heat-retentive fibrous material to provide high thermal efficiency in exchanging heat and moisture between inlet and exhaust air streams for residential, commercial and industrial applications.

34 Claims, 7 Drawing Sheets

10
14
14a
14b
16
18
19
20
21
22
22'
24
24'
26
27
27'
28
29
29'
30
31
32
34
34a
36
36a
38
38a
40
42
44
46
48
50
52
52a
54
54a
12

AIR TO AIR HEAT RECOVERY VENTILATOR

CROSS-REFERENCE TO RELATED APPLICATIONS

This is a continuation-in-part of U.S. Pat. No. 5,069,272, issued Dec. 3, 1991, from U.S. Ser. No. 395,044 filed Aug. 17, 1989, the disclosure of which is hereby incorporated by reference.

BACKGROUND OF THE INVENTION

This invention relates to the use of air to air heat recovery ventilators to obtain thermally efficient ventilation of buildings and dwellings, and in particular, to a rotary wheel heat exchanger for room ventilators.

Heat exchangers are used in ventilation systems installed in residential, commercial and industrial buildings to extract and remove heat or moisture from one air stream and transfer the heat or moisture to a second air stream. In particular, rotary wheel heat exchangers are known wherein a wheel rotates in a housing through countervailing streams of exhaust and fresh air, in the winter extracting heat and moisture from the exhaust stream and transferring it to the fresh air stream. In the summer rotary wheel heat exchangers extract heat and moisture from the fresh air stream and transfer it to the exhaust stream, preserving building air conditioning while providing desired ventilation.

Fans or blowers typically are used to create pressures necessary for the countervailing streams of exhaust and fresh air to pass through the rotary wheel heat exchanger. Various media have been developed for use in rotary wheel heat exchangers to enhance heat and moisture transfer, for example, Marron et al, U.S. Pat. No. 4,093,435. Typical of rotary wheel heat exchangers are the devices shown by Hajicek, U.S. Pat. No. 4,497,361, Honmann, U.S. Pat. No. 4,596,284, and those used by Mitani, U.S. Pat. No. 4,426,853, and Coellner, U.S. Pat. No. 4,594,860, in air conditioning systems.

It has been found in the prior art that to achieve thermally efficient ventilation of rooms and buildings, rotary wheel heat exchangers require installation in rather large, fixed, or non-portable heat recouperators, such as that disclosed by Pennington, U.S. Pat. No. 2,807,258. The need exists, therefore, for smaller, portable heat exchangers and heat recovery ventilators which can still achieve thermally efficient ventilation. Further, the need exists for compact heat exchangers and heat recovery ventilators which may be used without the necessity of building modification, and may connect to existing ductwork in residential, commercial and industrial environments. This need is illustrated, for example, by the devices of Tengesdal, U.S. Pat. No. 4,688,626, Zenker, U.S. Pat. No. 4,491,171, and Berner, U.S. Pat. No. 4,542,782. Finally, the need remains for improved heat exchanger media for rotary wheel heat exchangers to increase the efficiency of heat transfer between the countervailing air streams.

Typically heat recovery apparatuses in the prior art employ heat exchangers having a plurality of parallel passages running in the direction of flow, as in Marron et al, U.S. Pat. No. 4,093,435 and Coellner, U.S. Pat. No. 4,594,860. Such passages must be sufficiently small to maximize the total surface area for heat transfer, yet sufficiently large relative to their length to minimize resistance to gas flow. These constraints have made the materials used as the heat exchanger media critical to the effectiveness of such rotary wheel heat exchangers. Thus, for example, Marron et al, U.S. Pat. No. 4,093,435, disclose the use of corrugated paper of a specified composition, density, and thickness in a plurality of layers in a rotary wheel heat exchanger. Further combination with metal foil in a multi-layered material is disclosed. Coellner, U.S. Pat. No. 4,594,860, discloses the use of sheets of polymer film alternating with layers of corrugated or extruded polymer film or tubes, each layer having specified thermal conductivity and specific heat characteristics.

In addition to ordinary ventilation requirements of residential, commercial, and industrial buildings, the increasing importance of ventilation in residences due to the hazardous build-up of radon, formaldehydes, carbon dioxide and other pollutants presents a further need for inexpensive portable, compact, efficient heat recovery ventilators which are capable of window-mounting. A continuing need exists for the improved design of rotary wheel heat exchangers, including improved, efficient heat exchanger media which avoid the exacting material and design restrictions found in the prior art.

SUMMARY OF THE INVENTION

The present invention meets these needs by providing a compact rotary wheel heat recovery ventilator which may be designed to fit into room windows of a residence or to satisfy the needs of commercial or large industrial buildings. Thus, the present invention may be embodied in a stand-alone unit or incorporated into an existing air handling system. The present invention is also low cost in both construction and operation. Moreover, a new low cost, easily manufactured, heat exchanger medium is disclosed which has an average heat transfer effectiveness in excess of 90% regardless of temperature difference between inside and outside air.

The heat recovery ventilator features a random matrix media in a rotary wheel heat exchanger. As the heat exchanger rotates, it transfers sensible and latent heat energy between first and second streams of air or other gas through which it passes. While the description which follows refers to air, it is understood that the present invention may be used with other gases. The heat exchanger is located in a housing which is baffled to permit the oppositely directed first and second streams of air to pass through with a minimum of intermixing of the streams. Heat transfer efficiency achieved with random matrix media in the heat recovery ventilator is at least 90% for air, regardless of the temperature differential between the oppositely directed first and second air streams.

Against the backdrop of prior art heat exchangers, typified by media having a plurality of ordered parallel passages or ordered layers, strands or patterns, the media of the present invention is comprised of a plurality of interrelated small diameter, heat-retentive fibrous material, which, relative to the prior art, appear random, thus the term "random matrix media." Random matrix media, however, may encompass random assemblages of pieces or patches of somewhat more ordered patterns or matrices of small diameter heat-retentive fibrous material, again, which are randomly assembled and interrelated, but may appear superficially to be patterned. Of particular interest in the present invention are random matrix media of randomly interrelated, small diameter, heat-retentive fibrous material.

The random interrelation or interconnection of such fibrous material, whether by mechanical, chemical or thermal means for interrelating, results in a mat of material of sufficient porosity to permit the flow of air, yet of sufficient density to induce turbulence into the air streams and provide surface area for heat transfer. Such mats, further, may be cut to desired shapes for use in heat exchangers of various shapes. One fibrous material suitable for use is 60 denier polyester needle-punched felt having 90-94% porosity and approximately 5-6.5 pounds/ft.$^3$ density. However, Kevlar®, numerous polyester or nylon strands, fibers, staples, yarns or wires may be used, alone or in combination, to form a random matrix media, depending on the application. Once size and flow of the gas are determined, material selection exists in a broad range of filament diameters, overall porosity, density, mat thickness, and material thermal characteristics.

In operation, the heat exchanger may be rotated by various means, such as by belts, gears or, as shown, a motor-driven wheel contacting the outer periphery of the heat exchanger container. The random matrix media is retained in the container by various means for retaining, preferably screens, stretched over apertures in the faces of the container, which have openings of sufficient size to permit substantially free flow of air. Radial spokes, separately or in addition to screens, may also be used extending from the hub of the container through and supporting the random matrix media. Seals are located between the heat exchanger and baffles, angles and brackets in the housing to prevent mixing of the separate first and second streams of air.

First and second air streams may be provided to the heat recovery ventilator from existing ducts, or from fans, blowers or the like located in the housing. In a first embodiment where fans are used to introduce the first and second air streams, in accordance with a first, preferred configuration, inlet and outlet vents are provided in the housing and are oriented to inhibit recirculation of air from the separate streams. In a second configuration, the inlet and outlet are adapted with means for connecting to existing ducts.

Regardless of the configuration, if desired, filters may be added at the inlet or outlet to filter the first or second stream of air. However, the random matrix media itself performs some filtering functions, for example, of pollen, which although driven to the surface of the random matrix media at the inlet, generally does not penetrate the random matrix media and may be blown outward as the heat exchanger rotates through the countervailing exhaust air. Similarly moisture attracted to or condensed in the random matrix media at an inlet is reintroduced in the countervailing exhaust stream. Thus, the present invention may also serve as a moisture exchanger.

In a second embodiment blowers, rather than fans, are used to produce the first and second streams of air. While in a first configuration inlet and outlet vents may again be provided, a second configuration is preferred, wherein means for connecting the housing to existing ducts are provided. Again, filters may be provided at the inlets or outlets in the second embodiment.

Because of the heat transfer efficiency of the random matrix media and related material characteristics, the deliberate inducement of turbulence, and the large surface area for heat transfer, random matrix media lend themselves to minimizing heat exchanger thickness, and permit development of a low cost, compact, portable window-mountable heat recovery ventilating unit for residential use. For the same reasons, the present invention may also be applied to meet the largest commercial and industrial applications for rotary wheel heat exchangers.

DETAILED DESCRIPTION OF THE PREFERRED EMBODIMENT

Figure 1:
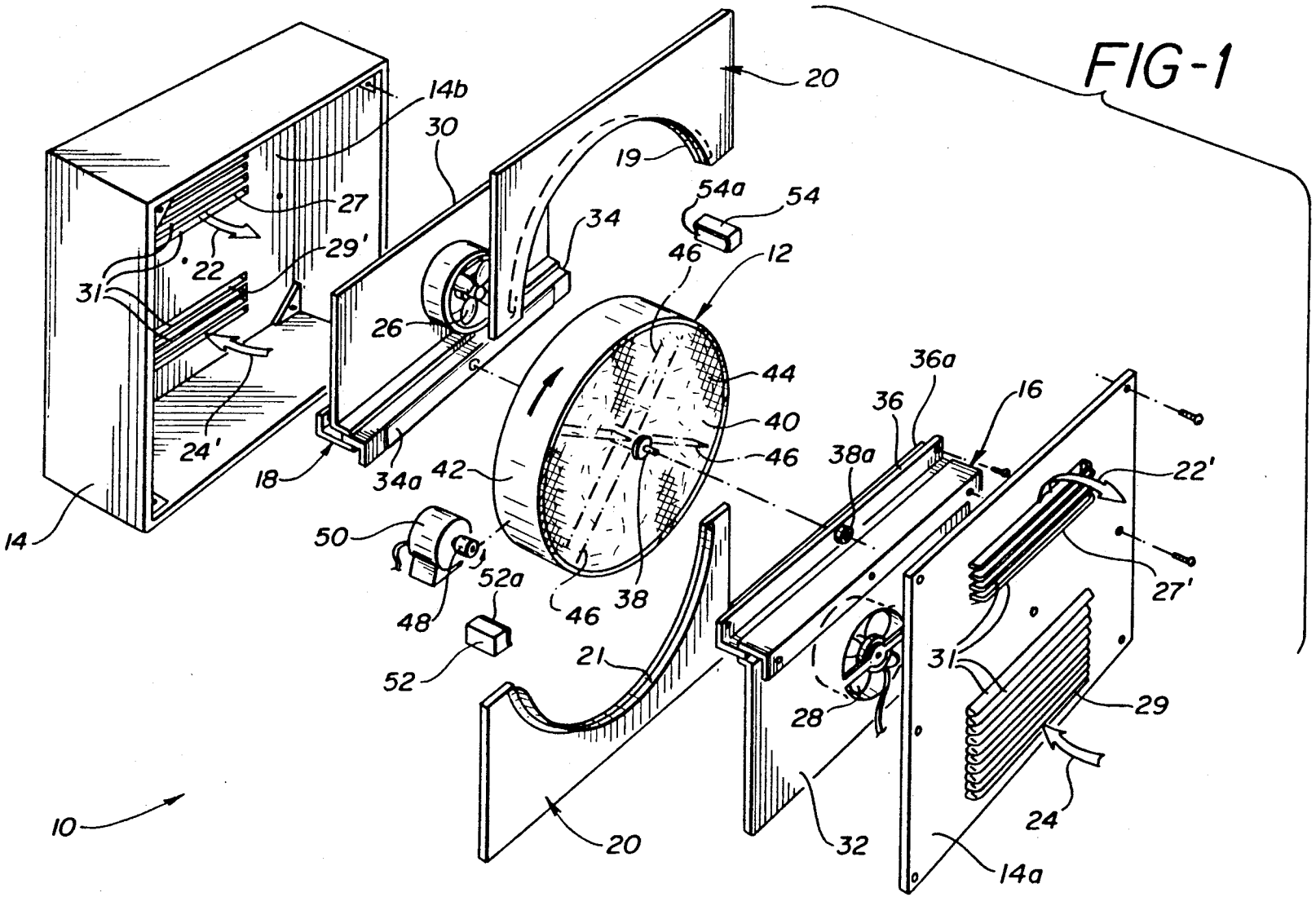
FIG. 1 is an exploded perspective view of the first embodiment of the heat recovery ventilator of the present invention in a first configuration.

Referring to FIG. 1, a heat recovery ventilator 10 consisting of a rotary wheel heat exchanger 12, and a housing 14 with baffles 16, 18 and peripheral baffle 20, provides for two oppositely directed streams of air 22, 24 to pass through heat exchanger 12. Flexible seals 19 and 21, preferably of a Teflon®-based material, attach to peripheral baffle 20, to prevent streams of air 22 and 24 from circumventing heat exchanger 12.

Figure 2:
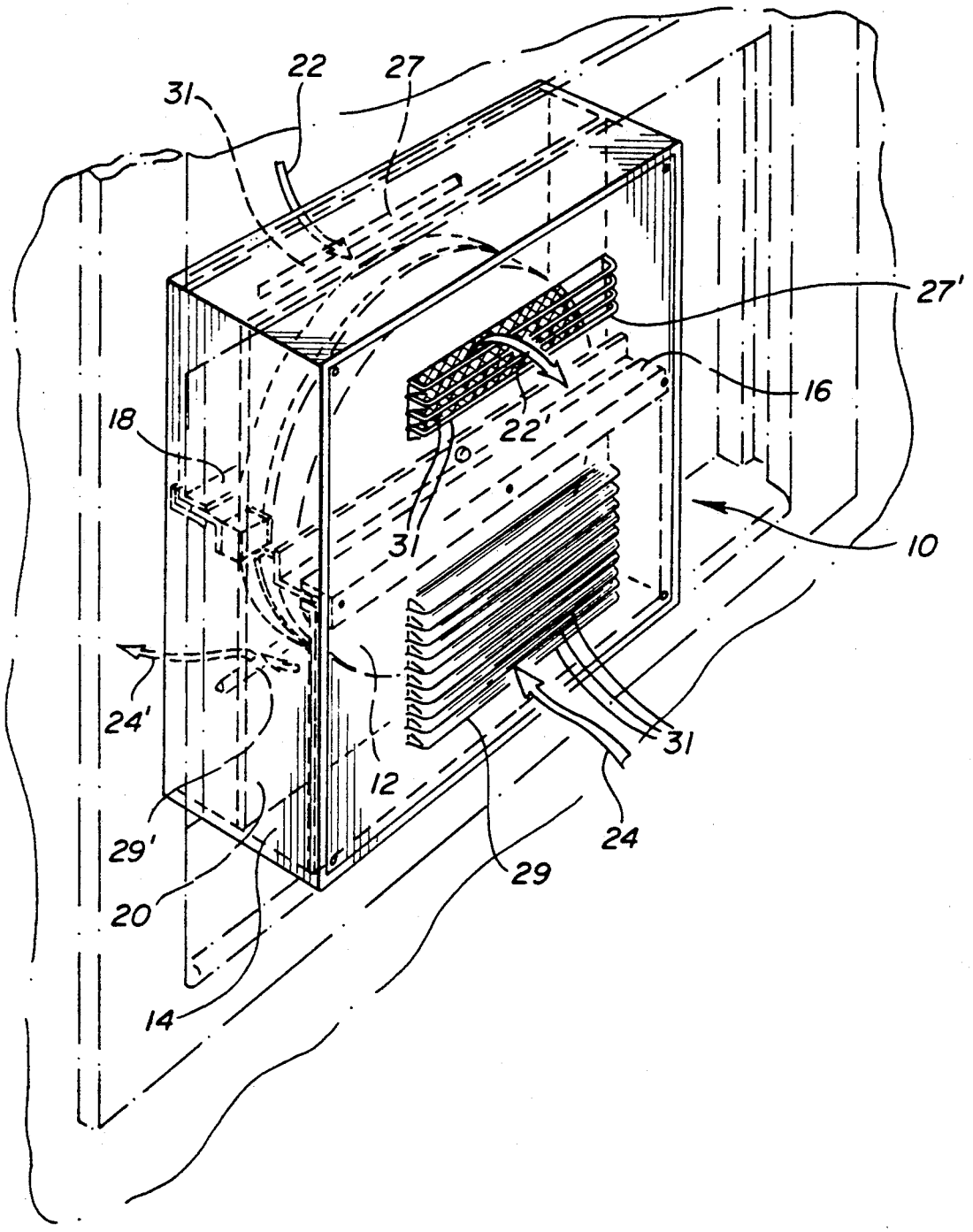
FIG. 2 is a perspective view of the assembled heat recovery ventilator of FIG. 1.
Figure 3:
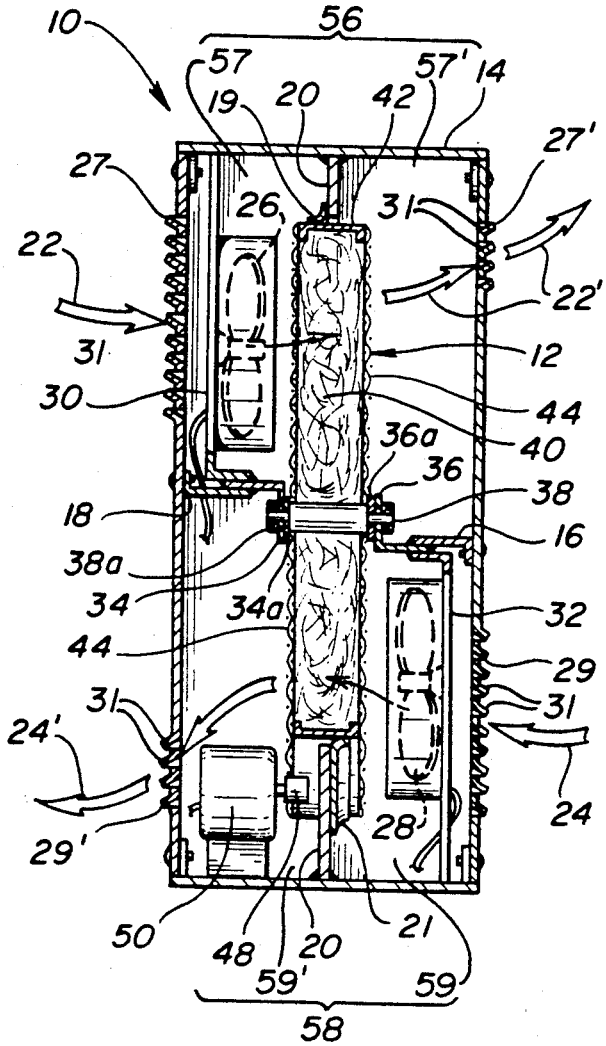
FIG. 3 is a side elevational view of the heat recovery ventilator of FIG. 2.
Figure 4:
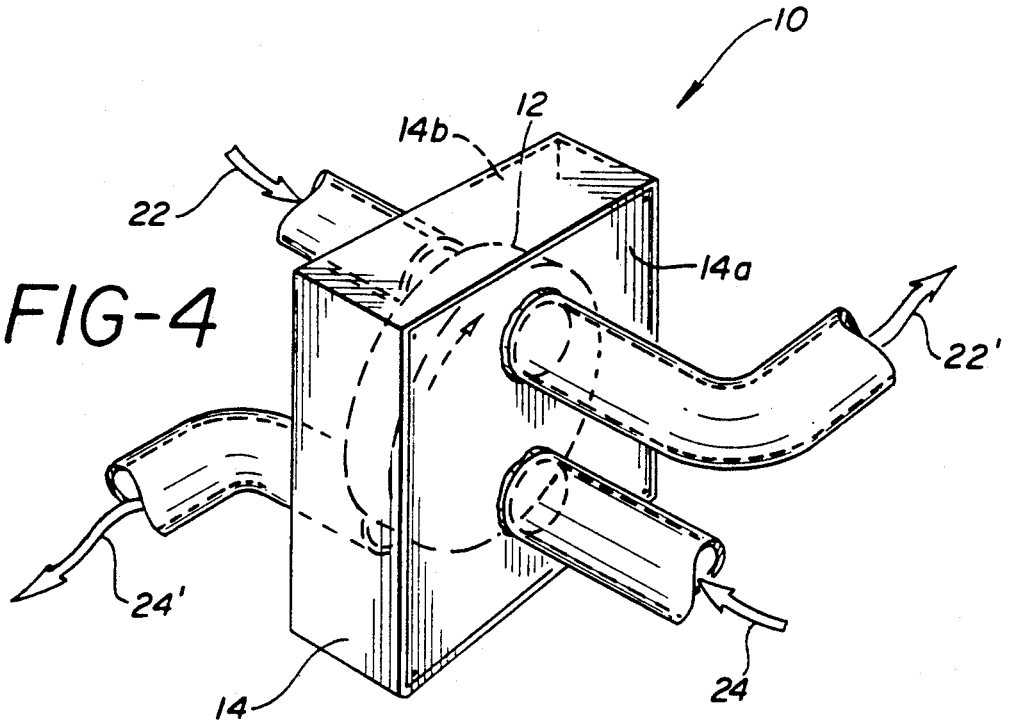
FIG. 4 is a perspective view of the first embodiment of the heat recovery ventilator of the present invention in a second, alternative configuration.

Two configurations of the first embodiment are shown in FIGS. 1-4. A first, window-mounted configuration is shown in FIGS. 1-3. In the second configuration of FIG. 4, the front and back panels **14*a* and 14*b* of housing 14 are modified to connect to existing ducts. In both configurations of FIGS. 1-4, means to force streams of air through heat exchanger 12 are motor driven fans 26 and 28. Fans 26 and 28 may be located at inlets or outlets 27, 29 or 27', 29', but are preferably located at alternate inlets 27 and 29, respectively. Fans 26, 28 are mounted on fan mounting plates 30 and 32 which are supported, in part, by mounting angles 34 and 36**, and are connected to a source of electricity (not shown).

Figure 10:
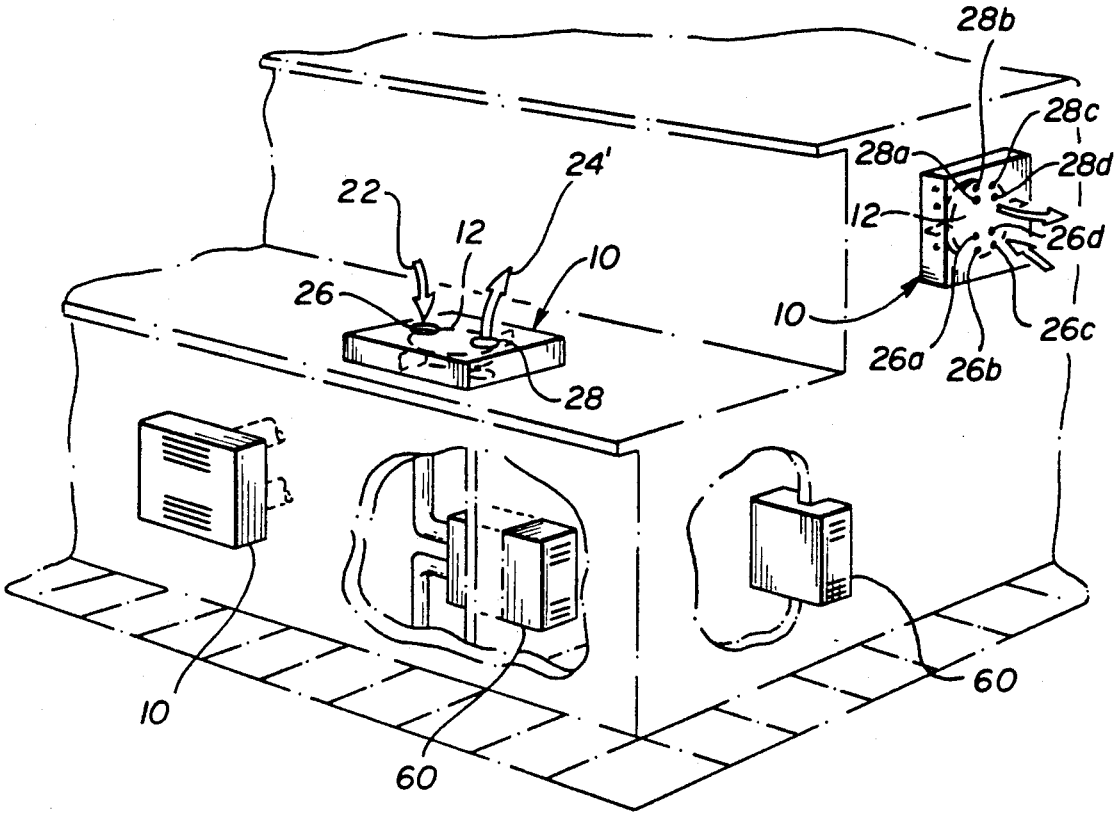
FIG. 10 is a perspective view of representative alternative configurations and systems applications of the heat recovery ventilator of the present invention.

In a third, alternative configuration, representatively shown in a roof-mounted configuration in FIG. 10, both fans 26 and 28 are mounted on the same side of heat exchanger 12 at inlet 27 and outlet 29', respectively. As further representatively shown in a fourth configuration in FIG. 10, a plurality of fans **26*a*-26*d* and 28*a*-28*d* may be provided. Regardless of the location of fans 26** and 28, vents 31 at inlets 27, 29 and outlets 27' and 29' are oriented to inhibit recirculation of streams of air 22 and 24.

In a fifth configuration, fans 26, 28 may be entirely removed from heat recovery ventilator 10 where, for example, connection to an existing air handling system provides sufficient pressure differential across heat recovery ventilator 10 to force streams of air 22, 24 therethough.

Referring to FIGS. 1-3, the details of the first embodiment of recovery ventilator 10 may be examined in greater detail. Heat exchanger 12 is rotatably mounted on an axle assembly 38 such as is known in the art, typically comprising bearings 38*a*. Axle assembly 38 is supported by mounting angles 34 and 36. Seals 34*a* and 36*a*, such as Teflon®-based tapes, cover flanges of mounting angles 34 and 36, respectively, and abut screens 44 covering the faces of heat exchanger 12. Seals 34*a* and 36*a* typically are designed to contact screens 44 initially and wear to a level which maintains a desired seal between air streams 22 and 24', and 22' and 24.

Mounting angle holders 52 and 54 are attached to housing 14 by conventional means and support mounting angles 34 and 36. Preferably mounting angle holders 52 and 54 are injection molded to match as closely as possible the outer circumference of container 42. Alternatively, the surfaces of mounting angle holders 52 and 54 are machined to match as closely as possible to the outer circumference of container 42. Seals 52*a* and 54*a*, such as Teflon®-based tapes, may also be placed on surfaces of mounting angle holders 52 and 54 adjacent to the container 42. Designed to initially contact container 42, seals 52*a* and 54*a* wear to a level which is designed to maintain the desired seal between air streams 22 and 24', 22' and 24, 22 and 22', and 24 and 24'. It is preferred, however, to fabricate mounting angle holders 52, 54 to tight tolerances to provide the desired sealing.

Figure 11:
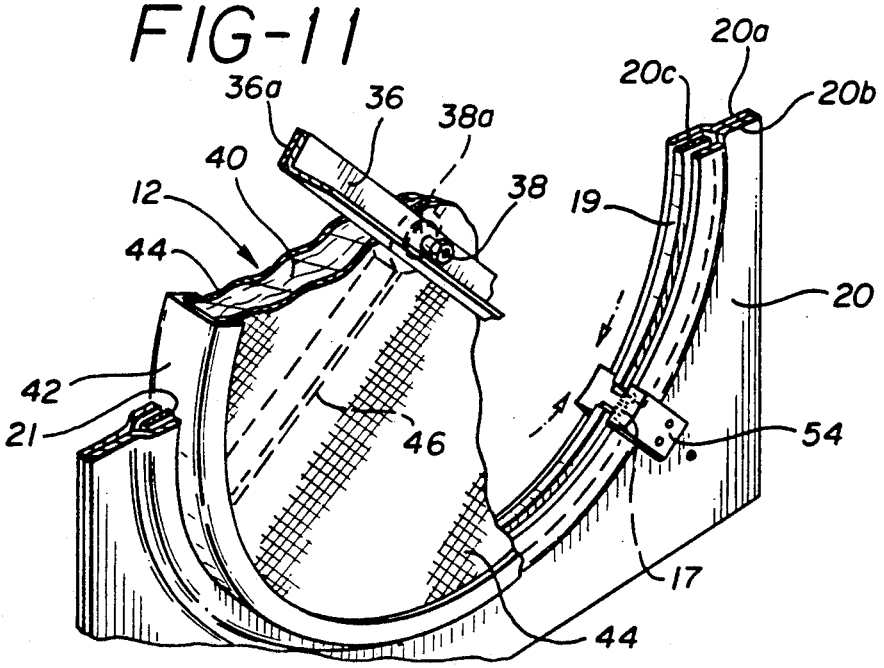
FIG. 11 is an enlarged perspective view of the peripheral baffle and flexible seals taken at line 11 in FIG. 9.

Flexible seals 19 and 21 may be positioned and attached by conventional means as shown in FIG. 1, preferred for simplicity. Alternatively, peripheral baffle 20 and flexible seals 19, 21 may be assembled in cooperation with mounting angle holders 52, 54, and springs 17 as shown in FIG. 11 and further described in detail below.

Thus, referring to FIG. 3, when the structure of the first embodiment is viewed as a whole, it may be seen that baffles 16, 18, mounting angles 34, 36, and mounting angle holders 52, 54, define first and second sections 56, 58 in housing 14 through which oppositely directed streams of air 22, 24 pass. Further, it may be seen that first section 56, so defined, has an inlet side or chamber 57 and an outlet side or chamber 57', and second section 58 has an inlet side or chamber 59 and an outlet side or chamber 59'.

A second embodiment of the present invention is shown in FIGS. 5-9, where like numbers represent like elements. In the second embodiment, heat recovery ventilator 60 includes a rotary wheel heat exchanger 12 rotatably mounted in housing 14. Peripheral baffle 20, first and second baffle assemblies 66, 68 and first and second duct sections 70, 72 define first and second sections 56, 58 in housing 14 through which the two oppositely directed streams of air 22 and 24 pass. In the second embodiment, means to force streams of air 22, 24 through heat recovery ventilator 60 comprise blowers 62, 64, respectively.

In a first configuration, representatively shown in FIG. 10, vents 31 are provided at one or more of the inlets 27, 29 and outlets 27', 29' of heat recovery ventilator 60. In the second, preferred, configuration, inlets and outlets 27, 29 and 27', 29' include means for mounting heat recovery ventilator 60 to existing ducts, as shown in FIGS. 5-9. Heat recovery ventilator 60 is best suited for use in systems applications, thus the second configuration is preferred.

With reference to FIGS. 5-9, the second embodiment may be described in more detail. Blowers 62, 64 are located, respectively, on mounting plates 30, 32, and connected to a source of electricity by conventional means for wiring (not shown). Mounting plates 30, 32 are in turn supported, respectively, by first and second baffle assemblies 66 and 68. Blowers 62, 64 initiate streams of air 22, 24, respectively, by suction across a portion of heat exchanger 12. For example, stream of air 22 entering inlet 27 is drawn into inlet chamber 57 and across heat exchanger 12 into outlet chamber 57' by blower 62. Blower 62, further connected to first duct section 70, exhausts stream of air 22' out through outlet 27'. In like fashion, stream of air 24 is drawn through inlet 29 into inlet chamber 59, across heat exchanger 12 into outlet chamber 59', and exhausted by blower 64 through second duct section 72 and outlet 29'.

Blowers 62, 64 may, alternatively, be located in inlet chambers 57 and 59, respectively, to blow streams of air 22, 24 across heat exchanger 12, however, this alternative configuration is not preferred.

In the preferred configuration of the second embodiment, means for connecting heat recovery ventilator 60 to existing ducts are provided. As shown in FIGS. 5-9, such means may comprise male duct nipples 82 with corrugated ends, as known in the art. However, such means for connecting may comprise a flange mounted on the inside or outside of housing 14, a bolt pattern, or other structure which is needed to connect housing 14 to existing ducts. Further, first and second duct sections 70, 72 are preferably funnel-shaped to enhance blower efficiency.

As in the first embodiment, in the various configurations of the second embodiment, heat exchanger 12 is rotatably mounted in heat recovery ventilator 60 on axle assembly 38 typically comprising bearings 38*a* as known in the art. Axle assembly 38 is supported by mounting angles 34 and 36. Again, seals 34*a* and 36*a* cover flanges of mounting angles 34 and 36, respectively, and abut screens 44 covering the faces of heat exchanger 12. As before, seals 34*a* and 36*a* maintain the desired seal between air streams 22 and 24', and 22' and 24. Mounting angle holders 52 and 54 are, as discussed above, preferably injection molded to tight tolerances, thus requiring no separate seals, but may also, alternatively, be provided with seals 52*a*, 54*a*.

Figure 5:
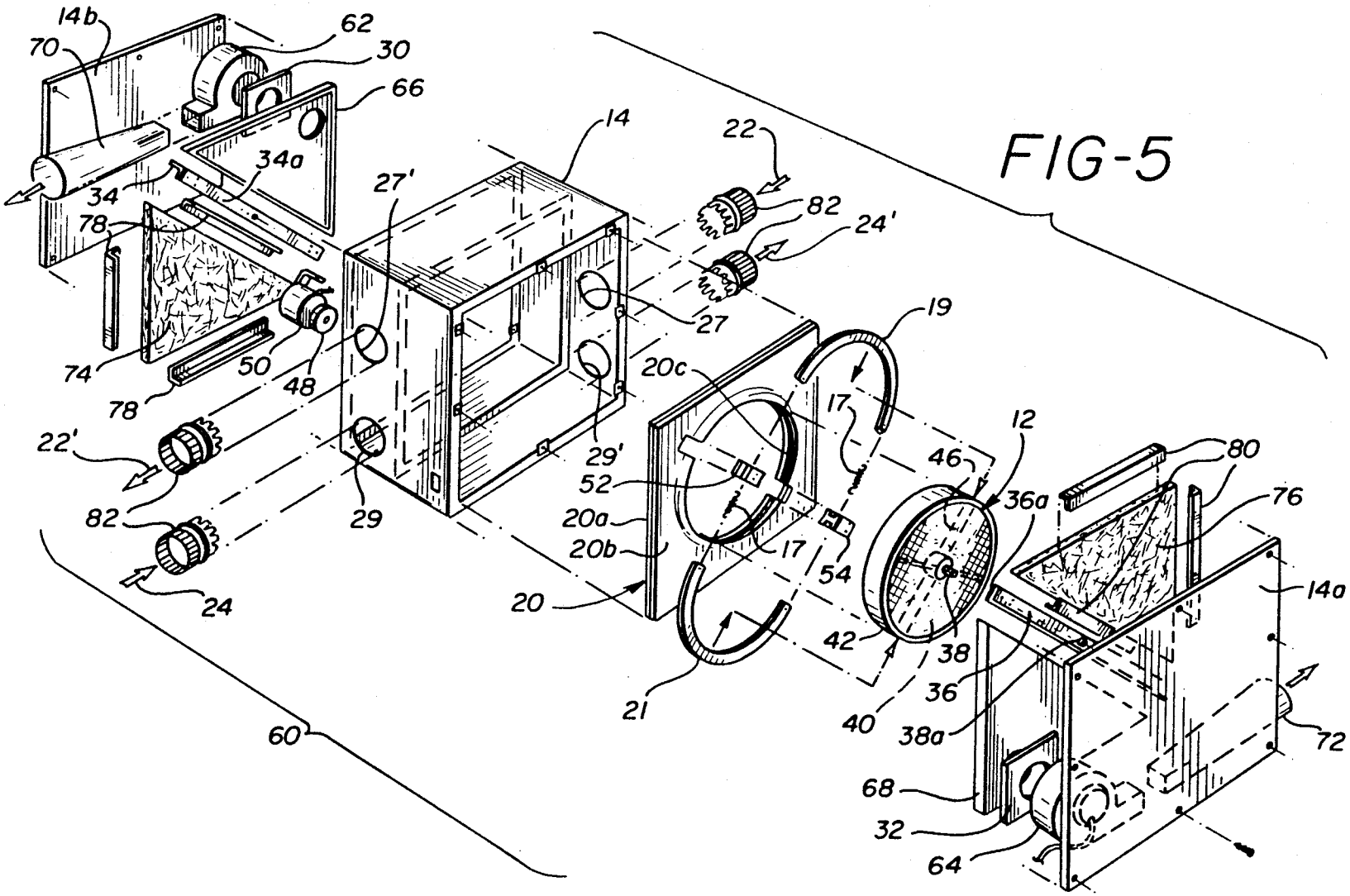
FIG. 5 is an exploded perspective view of the second embodiment of the heat recovery ventilator of the present invention in its preferred configuration.
Figure 6:
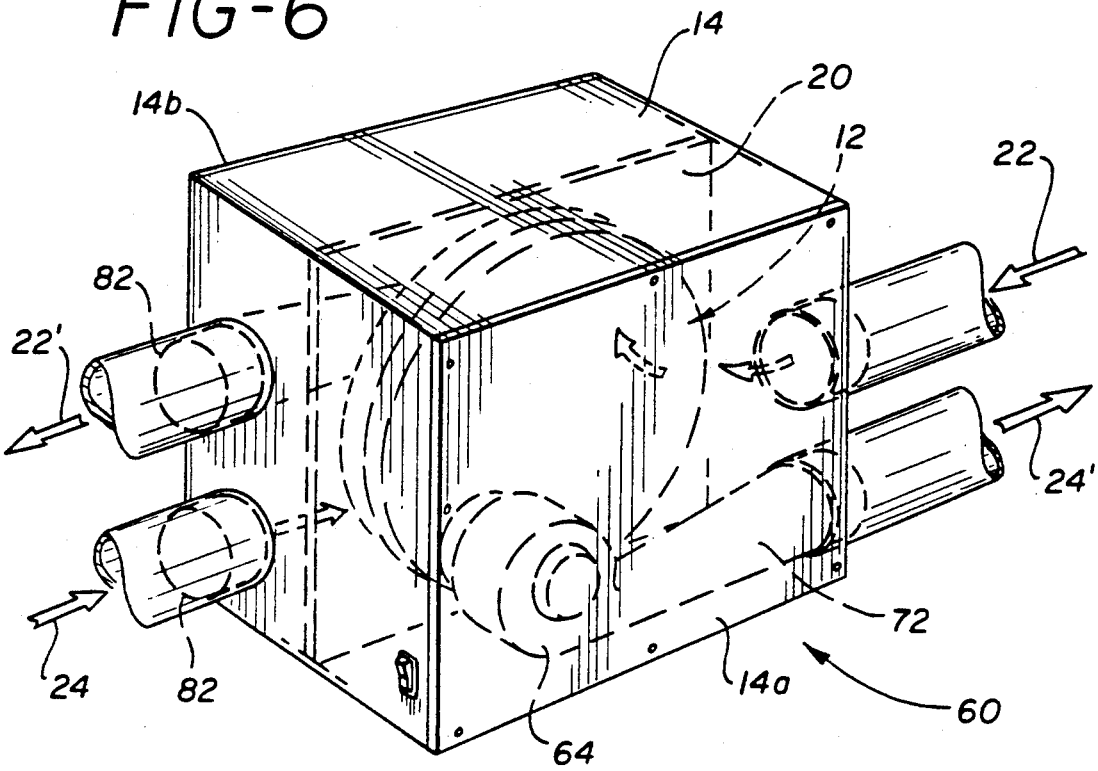
FIG. 6 is a perspective view of the assembled heat recovery ventilator of FIG. 5.
Figure 7:
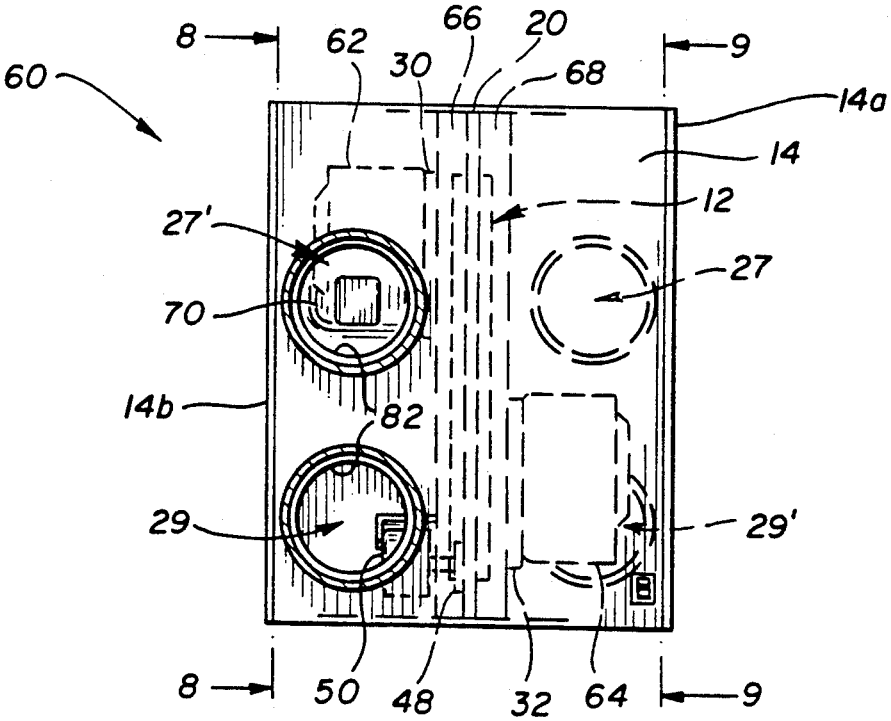
FIG. 7 is a side elevational view of the heat recovery ventilator of FIG. 6.
Figure 8:
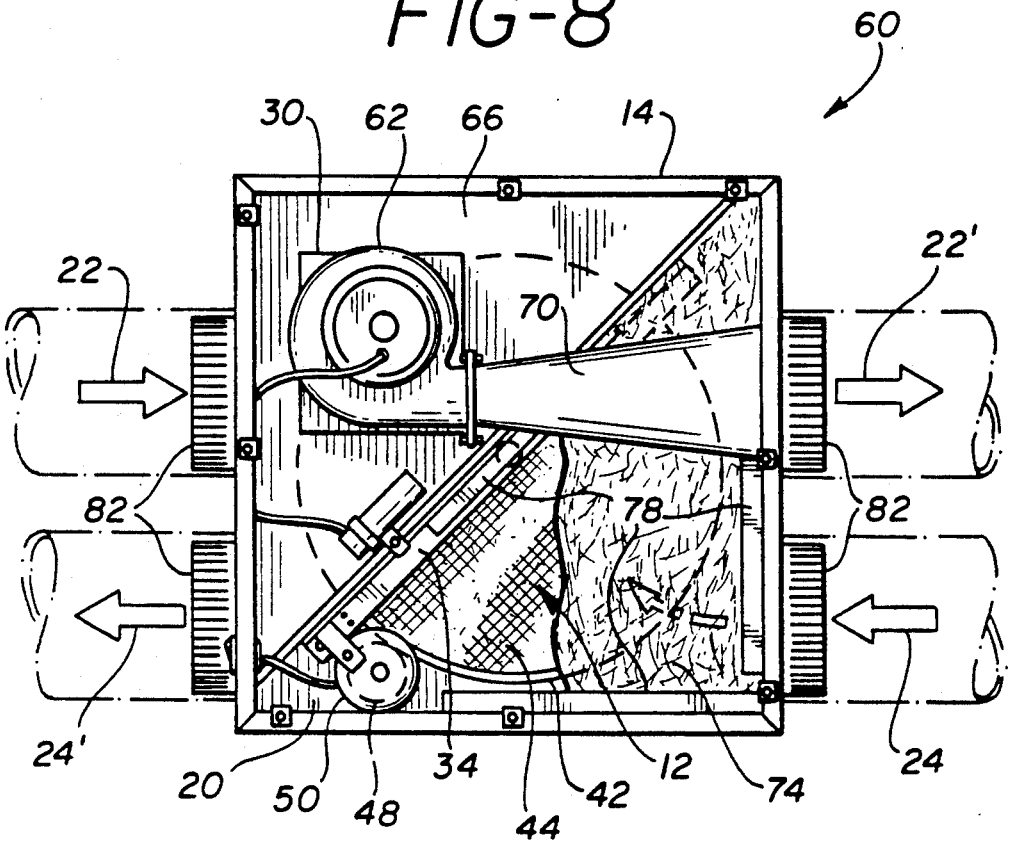
FIG. 8 is a front elevational view of the heat recovery ventilator of FIG. 7 with the front panel removed, taken at line 8—8.
Figure 9:
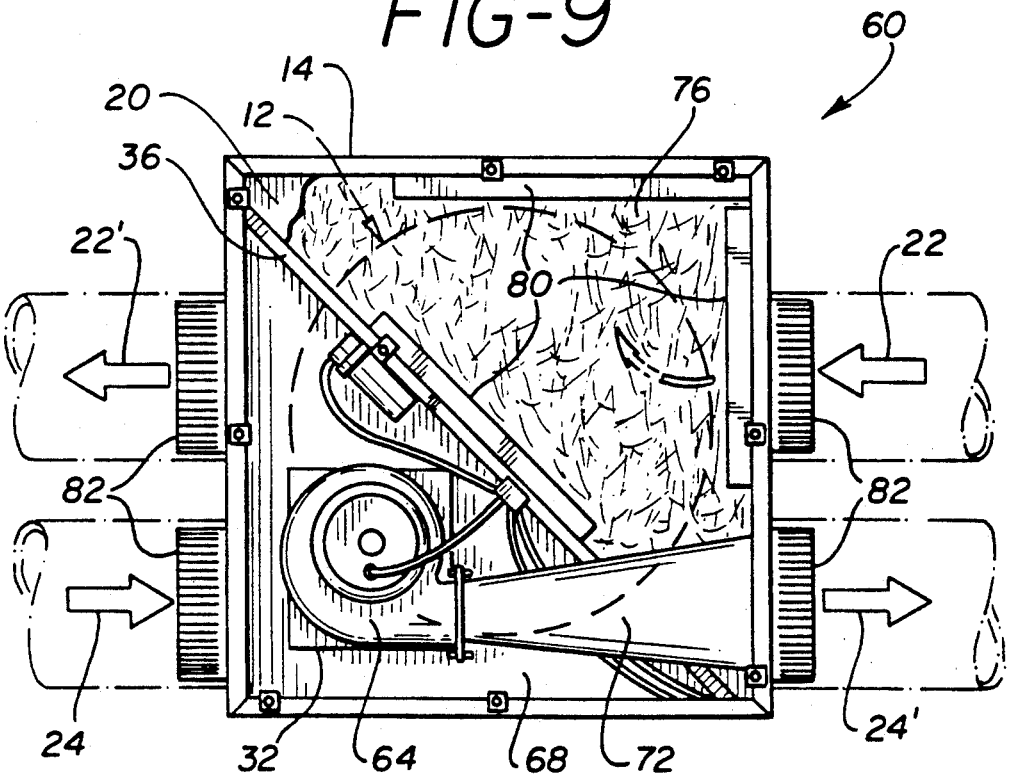
FIG. 9 is a rear elevational view of the heat recovery ventilator of FIG. 7 with the rear panel removed, taken at line 9—9.

As well, flexible seals 19 and 21, preferably of a Teflon®-based material, are attached to peripheral baffle 20, to prevent streams of air 22 and 24 from circumventing heat exchanger 12. As shown in FIGS. 5 and 11, in the second embodiment, flexible seals 19 and 21 are preferably disposed in a groove 20*c* formed between two sheets 20*a* and 20*b* which comprise peripheral baffle 20. Best shown in FIG. 11, springs 17, disposed in holes through mounting angle holders 52, 54, attach to flexible seals 19 and 21 to keep flexible seals 19 and 21 in sealing contact with the outer circumference of container 42.

In the second embodiment, as shown in FIG. 5, it is preferred to include filters 74 and 76 in inlet chambers 27 and 29 to filter incoming air streams 22 and 24, respectively. Means for positioning filters 74, 76 are also preferred. Thus, filter positioning angles 78 and 80 are provided to block filters 74 and 76, respectively, away from the faces of heat exchanger 12, and to position filters 74, 76 for a friction fit between the walls of housing 14 and first and second baffle assemblies 66, 68, respectively.

In a third configuration, blowers 62, 64 are eliminated and heat recovery ventilator 60 is connected to existing ducts (not shown) of an air handling system. In the third configuration, the pressure differential present in the air handling system is relied upon to force streams of air 22, 24 through the heat recovery ventilator. In the third embodiment, first and second duct sections 70, 72 may connect directly to first and second baffle assemblies 66, 68, respectively. Alternatively, first and second baffle assemblies 66, 68 may be replaced by baffles 16, 18 which attach (as in FIGS. 1-3) to mounting angles 36, 34, and front and back panels 14*b*, 14*a*, respectively, to define outlet chambers 66, 68.

In all configurations of both the first and second embodiment of the present invention, shown in FIGS. 1-11, heat exchanger 12 contains random matrix media 40 consisting of a plurality of interrelated small diameter, heat-retentive, fibrous material. Such materials may be randomly interrelated by mechanical, thermal or chemical means for interrelating. Mechanical means for interrelating may be, for example, needle-punching. Thermal means for interrelating may, for example, comprise radiant heat or ultrasonic methods for bonding adjacent fibers or filaments. Chemical means for interrelating may, for example, involve known methods for bonding adjacent, randomly interrelated filaments with adhesives.

Whether entirely random, or superficially maintaining some semblance of a pattern by comprising a randomly interrelated assemblage of materials having somewhat more ordered patterns, the fibrous material of the random matrix media, preferably, forms a mat of material which is easy to work with, handle and cut to shape. The random matrix media may be made from one or more of many commercially available filaments, fibers, staples, wires or yarn materials, natural (such as metal wire) or man-made (such as polyester and nylon). Filament diameters from substantially about 25 microns to substantially about 150 microns may be used. Below substantially about 25 microns, the small size of the filaments creates excessive resistance to air flow, and above about 150 microns inefficient heat transfer results due to decreased surface area of the larger filaments. Single strand filaments from substantially about 25 microns to substantially about 80 microns in diameter are preferred, for example a 60 denier polyester needle-punched felt having filament diameters of about 75 to 80 microns.

The present invention is distinguished from the prior art in that deliberate turbulence, rather than directed flow through parallel passages is encouraged by and adds to the effectiveness of the random matrix media. While turbulence in the random matrix media is desirable, resistance to air flow should not be excessive. The mat of material which forms the random matrix media should have a porosity (i.e., percentage of open space in total volume) of between substantially about 83% and substantially about 96%. Below substantially about 83%, resistance to air flow becomes too great, and above substantially about 96% heat transfer becomes ineffective due to the free flow of air. Preferably the mat thickness should be less than 6" to prevent excessive resistance to air flow. Porosity is preferable from substantially about 90% to substantially about 94%, as for example, with 60 denier polyester needle-punched felt, having a porosity of about 92.5%. Representative of random matrix materials which may be used in heat exchanger 12, 60 denier polyester needle-punch felt has a specific gravity of approximately 1.38, thermal conductivity of approximately 0.16 watts/m ° K. and specific heat of approximately 1340 j/Kg ° K.

With reference to FIGS. 1-3, 5-9, and 11, in heat exchanger 12, random matrix media 40 is retained by means for retaining, such as container 42. Container 42 preferably encloses random matrix media 40 around its periphery, and supports and retains the random matrix media 40 with screens 44 stretched tightly over apertures in the faces of container 42. Alternatively, radial spokes 46, shown in FIGS. 1, 5 and 11, may be used in lieu of or in addition to screens 44 to support and retain random matrix media 40. Container 42 is preferably made of a lightweight material whose coefficient of expansion generally matches that of the aluminum used for mounting angles 34, 36. Where, for example, 6063-T6 aluminum is used for mounting angles 34, 36, a 30% glass-filled polyester plastic, such as VALOX 420, Grade 420-SEO from The General Electric Co., is preferred because of its closely matching coefficient of expansion, $1.4\times10^{-5}$ inches/inch ° Fahrenheit (° F.).

In operation, heat exchanger 12 is rotated by contact between wheel 48, driven by motor 50, and the outer circumference of container 42 as shown best in FIGS. 1, 3 and 5. Motor 50 is connected to a source of electricity (not shown). Rotation of heat exchanger 12 is preferably between about 10 revolutions per minute (rpm) and about 50 rpm. Below about 10 rpm, overall efficiency of the heat recovery ventilator 10 declines. Above about 50 rpm, cross-over or mixing between air streams 22 and 24 occurs as heat exchanger 12 rotates, reducing the amount of ventilation provided. Wheel 48 is preferably made of a rubber having characteristics which promise a long life expectancy for the frictional application of the present invention and for the range of temperatures in which heat recovery ventilator 10 or 60 is expected to operate. A preferred rubber for applications in the expected range of ambient temperatures for air, generally −20 to 130 F., is a carboxylated nitrile available from the Rubber Development Corp., San Jose, Calif.

The random matrix media 40 may be used in heat exchangers 12 of various sizes for various applications. For example, in the first embodiment of the first configuration, shown in FIG. 2, a compact portable window-mounted heat recovery ventilator 12 may include a 20 inch×20 inch×8.5 inch housing and a 17 inch diameter by 1.6 inch thick heat exchanger. The heat exchanger may be rotated at 35 rpm–45 rpm, with appropriate fans to supply from 80 to 150 cubic feet per minute (cfm) of air, to operate with a thermal efficiency of generally 90% over a wide range of temperature differences. The random matrix media 40 of the present invention may be used in heat recovery ventilators of many sizes for numerous, varied ventilating applications, ranging from approximately 20 cfm for rooms, representatively shown in FIG. 2, to in excess of 30,000 cfm for large commercial and industrial applications, shown typically in FIG. 10. In some applications, heat recovery ventilators using random matrix media 40 may be placed in forced-air systems and connected to one or more ducts which carry counter-flow streams of air or gas, shown typically in FIGS. 4, 6 and 10.

In any application, filters may be added to filter inside or outside air at inlets 27, 29 or outlets 27', 29', or in inlet chambers 57, 59, or outlet chambers 57', 59'. As well, the random matrix media 40 itself functions as a filter for some particulates. For example, pollen driven to the surface of the heat exchanger 12 at the inlet of a first stream does not substantially penetrate the surface of the random matrix media 40 and may be removed with the exhaust of the second stream. Similarly, moisture condensed at the inlet of a first stream is carried away from the surface of the random matrix media 40 by the exhaust air of the second steam. The present invention may thereby serve as both a heat and humidity exchanger. Thus, air quality and temperature may be substantially maintained by the random matrix media 40.

Precise selection of material, composition, filament size, porosity and width of the random matrix media 40 as well as the rate of rotation of heat exchanger 12 and selection of size of fans 26, 28 may vary with each application. However, once the size and flow (and, in some cases, the gas) required for a particular application are fixed, the fans and other components may be sized, and the random matrix media 40 may be selected from appropriate materials within the range of characteristics, particularly filament size and porosity, noted above. Chart 1 below lists typical parameters for the present invention in representative applications for air.

Chart 1: Representative Heat Recovery Ventilator Applications

| Air Flow (cfm) | Application | Disk Diameter (cms) | RPM | Fan Static Pressure (inches of water) | Effectiveness (%) |
|---|---|---|---|---|---|
| 20 | Room | 25 | 20 | .12 | 92.0% |
| 30 | Room | 25 | 20 | .20 | 90.0% |
| 80–150 | Small to medium-sized houses | 43 | 34–45 | .35 | 90.0% |
| 200 | full medium | 80 | 20 | .11 | 92.5% |
| | to large house | 43 | 40–50 | .45 | 90.0% |
| 300 | Large house | 80 | 20 | .18 | 91.0% |
| 500 | Small commercial such as a restaurant | 100 | 40 | .20 | 91.0% |
| 650 | Small to medium commercial | 100 | 40 | .27 | 90.0% |
| 30,000 | large commercial, or industrial | variable depending on application, pressure losses in duct work, etc. | | | 90.0% |

All components of heat recovery ventilator 10 and 60 are commercially available and made of materials known and used in the art, except for special materials applications specified. Housing 14, various baffles 16, 18, 20, 66 and 68, mounting plates 30, 32, mounting angles 34, 36, positioning angles 78, 80, first and second duct sections 70, 72, and nipples 82 are preferably made of light-weight materials such as plastics, aluminum or mild steel, and are connected by conventional means such as bolts and nuts, welding, bending, sealing or the like. Conventional seals or sealant material (not shown) may also be further used to seal the various elements where connected to prevent intermixing of streams of air 22, 24, or leakage of ambient air.

While certain representative embodiments and details have been shown and described for purposes of illustrating the invention, it will be apparent to those skilled in the art that various changes in the apparatus disclosed herein may be made without departing from the scope of the invention which is defined in the appended claims. It is further apparent to those skilled in the art that applications using the present invention with gases other than air may be made without departing from the scope of the invention defined in the appended claims.

What is claimed is:

1. A heat recovery ventilator for ventilating rooms and buildings with minimum loss of heating or cooling, said heat recovery ventilator comprising:

a housing having first and second sections adapted to convey separate first and second streams of air, said housing further comprising a peripheral baffle secured to the inside of said housing, said peripheral baffle defining an aperture;

a heat exchanger disposed in said aperture, mounted for rotation within said aperture;

means for rotating said heat exchanger;

one or more seals communicating between said peripheral baffle and said heat exchanger, at least one of said one or more seals comprising a flexible seal, wherein said flexible seal is disposed in a groove in said peripheral baffle and extends from said groove into said aperture such that said flexible seal is disposed at least in part in said aperture around said heat exchanger; and means for retaining said flexible seal in tension around said heat exchanger such that said flexible seal is retained in tension around the periphery of said heat exchanger;

whereby said flexible seal is place in tension and maintains a substantially air-tight seal between said heat exchanger and said peripheral baffle.

2. A heat recovery ventilator as recited in claim 1 wherein said heat exchanger comprises a random matrix media and means for supporting said random matrix media, and said random matrix media comprises a mat of small diameter heat-retentive fibrous material randomly interrelated to form said mat.

3. A heat recovery ventilator as recited in claim 2 wherein said mat is comprised of filaments of from substantially about 25 microns to substantially about 150 microns and is adapted to have substantially 83% to 96% porosity.

4. A heat recovery ventilator as recited in claim 3 wherein said heat exchanger is adapted to be rotated from substantially about 10 to substantially about 50 rpm inside said housing.

5. A heat recovery ventilator as recited in claim 2 wherein said small diameter heat-retentive fibrous material is randomly interrelated by mechanical means for interrelating to form said mat.

6. A heat recovery ventilator as recited in claim 2 wherein said small diameter heat-retentive fibrous material is randomly interrelated by chemical means for interrelating to form said mat.

7. A heat recovery ventilator as recited in claim 2 wherein said small diameter heat-retentive fibrous material is randomly interrelated by thermal means for interrelating to form said mat.

8. A heat recovery ventilator as recited in claim 2 wherein said random matrix media is comprised of polyester filaments.

9. A heat recovery ventilator as recited in claim 8 wherein said random matrix media comprises polyester needle-punched felt.

10. A heat recovery ventilator as recited in claim 2 wherein said mat is substantially circular in shape.

11. A heat recovery ventilator as recited in claim 1, further comprising:

means to force said separate streams of air through said first and second sections of said housing in opposite directions.

12. A heat recovery ventilator as recited in claim 11 wherein said means to force said separate first and second streams of air comprise one or more blowers.

13. A heat recovery ventilator as recited in claim 12 wherein said one or more blowers are located at the outlet side of one or more of said first and second sections.

14. A heat recovery ventilator as recited in claim 11 wherein said means to force said separate first and second streams of air comprise one or more fans.

15. A heat recovery ventilator as recited in claim 14 wherein said one or more fans are located at the inlet side of one or more of said first and second sections.

16. A heat recovery ventilator as recited in claim 1 wherein said heat exchanger includes media and means for supporting said media, said means for supporting including:

a container enclosing at least a portion of said media; and means for retaining said media in said container, said container and said means for retaining adapted to allow substantially free passage of air through said media.

17. A heat recovery ventilator as recited in claim 16 wherein said means for rotating said heat exchanger comprises:

one or more motors; and means for transferring rotary motion of said one or more motors to said container, said means for transferring rotary motion comprising one or more drive wheels rotatably connected to said one or more motors and communicating with the periphery of said container.

18. A heat recovery ventilator as recited in claim 1 further comprising one or more filters disposed in at least one of said first and second sections, and means for positioning said filters.

19. A heat recovery ventilator as recited in claim 18 wherein a first filter is disposed in the inlet side of said first stream of air, and a second filter is disposed in the inlet side of said second stream of air.

20. A heat recovery ventilator as recited in claim 18 wherein said means for positioning said filters comprises one or more positioning angles.

21. A heat recovery ventilator as recited in claim 1 wherein said housing further comprises:

a six-sided, generally box-like frame, having one or more sides with one or more apertures communicating with said first and second sections;

one or more mounting angles disposed in said frame adjacent to said peripheral baffle and adapted for rotatably mounting said heat exchanger, said one or more mounting angles diagonally positioned generally towards opposing corners of said box-like frame which are farthest from said aperture defined in said peripheral baffle.

22. A heat recovery ventilator for ventilating rooms and buildings with minimum loss of heating or cooling, said heat recovery ventilator comprising:

a housing having first and second sections adapted to convey separate first and second streams of air, said housing further including a frame having at least four apertures, said apertures comprising a first inlet and a first outlet related to said first section, and a second inlet and a second outlet related to said second section said first and second inlets and outlets conveying said first and second streams of air along generally parallel paths in opposite first and second directions at said inlets and outlets;

a heat exchanger rotatably mounted in said housing and adapted to intersect said first and second sections, said heat exchanger disposed along a plane generally parallel to said first and second directions; and means for rotating said heat exchanger;

wherein said housing further comprises:

a peripheral baffle secured to the inside of said housing, said peripheral baffle having an aperture wherein said heat exchanger may rotate, portions of opposite first and second sides of said peripheral baffle and said heat exchanger defining first and second inlet chambers for said first and second sections, respectively, said first and second inlet chambers communicating with said first and second inlets, respectively;

one or more seals communicating between said peripheral baffle and said heat exchanger, adapted to prevent passage of air between said peripheral baffle and said heat exchanger;

first and second baffle assemblies disposed adjacent to portions of opposite second and first sides, respectively, of said peripheral baffle and said heat exchanger, defining therewith first and second outlet chambers for said first and second sections, respectively; and first and second duct sections extending from said first and second baffle assemblies, respectively, through said second and first inlet chambers, respectively, and connecting said first and second baffle assemblies to said first and second outlets, respectively.

23. A heat recovery ventilator as recited in claim 22 wherein said heat recovery ventilator further comprises first and second blowers disposed in said housing, communicating with said first and second baffle assemblies, and said first and second duct sections, respectively; and first and second means for mounting said first and second blowers, respectively.

24. A heat recovery ventilator as recited in claim 22 wherein said heat exchanger comprises a rotary wheel heat exchanger, and said opposite first and second sides thereof are positioned along planes generally parallel to said first and second directions, such that said first and second streams of air pass therethrough in directions generally perpendicular to said first and second directions.

25. A heat recovery ventilator as recited in claim 24 further comprising:

first and second means for forcing said separate first and second streams of air through said rotary wheel heat exchanger in opposite directions; and means for mounting said first and second means for forcing to said first and second baffle assemblies, respectively.

26. A heat recovery ventilator as recited in claim 22 further comprising:

one or more seals communicating between said peripheral baffle and said heat exchanger, at least a portion of one of said seals comprising a flexible seal, said flexible seal slidably disposed at least in part in said aperture around at least a portion of said heat exchanger; and means for retaining said flexible seal in tension around said heat exchanger to position said flexible seal radially inward as it wears such that said flexible seal is retained in tension around the periphery of said heat exchanger.

27. A heat recovery ventilator as recited in claim 26 wherein said flexible seal is disposed in a groove in said peripheral baffle and extends from said groove into said aperture such that said flexible seal is disposed at least in part in said aperture.

28. A heat recovery ventilator as recited in claim 22 wherein:

said heat exchanger comprises a media and means for supporting said media, and said means for supporting said media further including a container made of a first material and enclosing at least a portion of said random matrix media; and one or more mounting angles disposed in said frame and adapted for rotatably mounting said heat exchanger, said one or more mounting angles made of a second material having a coefficient of thermal expansion substantially similar to that of said first material;

whereby said heat recovery ventilator may operate substantially between −20 degrees fahrenheit and 130 degrees fahrenheit, and radial expansion and contraction of said container and the expansion and contraction of said one or more mounting angles is substantially matched.

29. A heat recovery ventilator for ventilating rooms and buildings with minimum loss of heating or cooling, said heat recovery ventilator comprising:

a housing having first and second sections adapted to convey separate first and second streams of air, said housing further comprising a peripheral baffle secured to the inside of said housing, said peripheral baffle defining an aperture;

a heat exchanger disposed in said aperture and mounted for rotation within said aperture;

one or more seals communicating between said peripheral baffle and said heat exchanger, wherein at least a portion of one of said seals comprises a flexible seal disposed at least in part in said aperture around the periphery of said heat exchanger, and slidably positionable relative to said periphery;

means for retaining said flexible seal in tension around said heat exchanger to slidably position said flexible seal radially inward as it wears such that said flexible seal is retained in tension around the periphery of said heat exchanger; and means for rotating said heat exchanger;

whereby said flexible seal is placed in tension and maintains a substantially air-tight seal between said heat exchanger and said peripheral baffle.

30. A heat recovery ventilator for ventilating rooms and buildings with minimum los of heating or cooling, said heat recovery ventilator comprising:

a housing having first and second sections adapted to convey separate first and second streams of air, said housing further comprising a peripheral baffle secured to the inside of said housing, said peripheral baffle defining an aperture;

a heat exchanger disposed in said aperture and mounted for rotation within said aperture;

one or more seals communicating between said peripheral baffle and said heat exchanger, at least one of said one or more seals comprising a flexible seal disposed at least in part in said aperture around said heat exchanger;

means for retaining said flexible seal in tension around said heat exchanger, said means for retaining said flexible seal in tension including:

at least one spring means for tensioning attached to at least one end of said flexible seal; and one or more mounting angle holders, at least one of said mounting angle holders adapted to receive said at least one spring means for tensioning; and mains for rotating said heat exchanger;

whereby said flexible seal is placed in tension and maintains a substantially air-tight seal between said heat exchanger and said peripheral baffle.

31. A heat recovery ventilator as recited in claim 30 wherein:

said housing further comprises one or more mounting angles generally diagonally disposed in said housing and attached to at least one of said one or more mounting angle holders; and said heat exchanger is rotatably mounted on said one or more mounting angles.

32. A heat recovery ventilator for ventilating rooms and buildings with minimum loss of heating or cooling, said heat recovery ventilator comprising:

a compact housing having first and second sections adapted to convey separate first and second streams of air, said housing further comprising a peripheral baffle secured to the inside of said housing, said peripheral baffle defining an aperture;

a heat exchanger disposed in said aperture and mounted for rotation within said aperture, said heat exchanger adapted to intersect said first and second sections;

means for rotating said heat exchanger;

one or more seals communicating between said peripheral baffle and said heat exchanger, at least one of said one or more seals comprising a flexible seal disposed at least in part in said aperture around said heat exchanger;

means for retaining said flexible seal in tension around said heat exchanger, said means for retaining said flexible seal in tension including:

at least one elastic means for tensioning attached to at least one end of said flexible seal; and one or more mounting angle holders, at least one of said mounting angle holders adapted to receive said at least a portion of said means for tensioning;

whereby said flexible seal is placed in tension and maintains a substantially air-tight seal between said heat exchanger and said peripheral baffle.

33. A heat recovery ventilator as recited in claim 32 wherein:

said elastic means for tensioning comprises at least one spring; and at least one mounting angle holder is adapted to receive at least one said spring.

34. A heat recovery ventilator for ventilating rooms and buildings with minimum loss of heating or cooling, said heat recovery ventilator comprising:

a housing having first and second sections adapted to convey separate first and second streams of air, said housing further including a frame having one or more sides with one or more apertures communicating with said first and second sections;

a heat exchanger comprising a media and means for supporting said media, said heat exchanger rotatably mounted in said housing and adapted to intersect said first and second sections, and said means for supporting said media further including a container made of a first material and enclosing at least a portion of said random matrix media;

one or more mounting angles disposed in said frame and adapted for rotatably mounting said heat exchanger, said one or more mounting angles made of a second material having a coefficient of thermal expansion substantially similar to that of said first material;

means for rotating said heat exchanger;

a peripheral baffle secured to the inside of said housing, having an aperture wherein said heat exchanger rotates; and one or more seals communicating between said peripheral baffle and said heat exchanger positioned to prevent passage of air between said peripheral baffle and said heat exchanger, at least one of said one or more seals comprising a flexible seal, wherein said flexible seal is disposed in a groove in said peripheral baffle and extends from said groove into said aperture such that said flexible seal is disposed at least in part in said aperture around said heat exchanger; and means for retaining said flexible seal in tension around said heat exchanger such that said flexible seal is retained in tension around the periphery of said heat exchanger;

whereby at least one of said one or more seals is placed in tension to maintain a substantially airtight seal between said peripheral baffle and said heat exchanger as said container and said one or more mounting angles expand and contract, and said heat recovery ventilator may operate substantially between −20 degrees fahrenheit and 130 degrees fahrenheit, and radial expansion and contraction of said container and the expansion and contraction of said one or more mounting angles is substantially matched.

* * * * *